US007156689B2

(12) United States Patent
Fabian et al.

(10) Patent No.: US 7,156,689 B2
(45) Date of Patent: Jan. 2, 2007

(54) DUAL WIRE CONNECTOR WITH MULTIPLE PRESS FIT CONNECTION

(75) Inventors: David James Fabian, Mount Joy, PA (US); Scott Stephen Dusterhoeft, Etters, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/036,673

(22) Filed: Jan. 14, 2005

(65) Prior Publication Data

US 2006/0160405 A1 Jul. 20, 2006

(51) Int. Cl.
*H01R 11/20* (2006.01)

(52) U.S. Cl. ..... 439/417

(58) Field of Classification Search ..... 439/417, 439/922, 620, 709, 535, 404, 724
See application file for complete search history.

(56) References Cited

U.S. PATENT DOCUMENTS

| | | | | | |
|---|---|---|---|---|---|
| 3,985,416 | A * | 10/1976 | Dola et al. | 439/403 |
| 5,605,470 | A * | 2/1997 | Braithwaite et al. | 439/417 |
| 5,695,361 | A * | 12/1997 | Elisei | 439/535 |
| 5,951,321 | A * | 9/1999 | Jaag | 439/405 |
| 6,168,456 | B1 * | 1/2001 | Saka et al. | 439/404 |
| 6,383,035 | B1 * | 5/2002 | Kasai | 439/724 |
| 6,692,284 | B1 * | 2/2004 | Koh | 439/346 |
| 6,729,915 | B1 * | 5/2004 | Ogawa | 439/733.1 |
| 6,846,183 | B1 * | 1/2005 | Kato et al. | 439/20 |

* cited by examiner

*Primary Examiner*—Tulsidas C. Patel
*Assistant Examiner*—Phuongchi Nguyen

(57) ABSTRACT

An electrical connector includes a nonconductive center housing and a plurality of substantially planar contacts situated within the housing. Each of the contacts includes an insulation displacement section, and at least one stuffer is slidably mounted to the housing and configured to engage a primary wire to more than one of the insulation displacement sections.

20 Claims, 4 Drawing Sheets

DUAL WIRE CONNECTOR WITH MULTIPLE PRESS FIT CONNECTION

BACKGROUND OF THE INVENTION

This invention relates generally to electrical connectors, and, more particularly, to electrical connectors for coupling to a continuous wire extending through the connector and interfacing multiple plug-in components to the wire.

Recent advances in illumination technology have resulted in the prolific use of distributed lighting assemblies in many applications. Distributed lighting assemblies are desirable, for example, for interior and exterior illumination of a vehicle, for decorative, accent, and safety lighting in business, homes, and outdoor illumination of sidewalks, swimming pools, steps, and even for directional and advertisement signage.

Conventional distributed light assemblies include a high intensity light source and a plurality of light transmission conduits (e.g., fiber optic cables, light pipes, and the like) for illuminating locations remote from the light source. A plurality of light sources (e.g., incandescent bulbs, halogen lamps, and the like) have been employed with an equal plurality of light transmission members to produce distributed lighting effects. It is difficult, however, to produce even lighting from the multiple light sources, and the assemblies are not as reliable as desired. Tubular light sources (e.g., neon, fluorescent, and the like) have been utilized to produce more even lighting, but are notably disadvantaged as requiring high voltage power supply converters to operate the tubes. Additionally, tubular light sources have poor impact resistance, rendering them unsuitable for many applications.

Recent technological advances in low voltage light sources, such as light emitting diodes (LEDs), now present low voltage light sources as viable candidates as light sources for distributed lighting assemblies. Low voltage light sources operate at a small fraction of the electrical power of conventionally used light sources and are an attractive option for use in distributed lighting assemblies due to generally lower cost and higher efficiency than conventionally used light sources. Thus far, however, obtaining a reliable and even light output from low voltage light sources in a distributed lighting assembly has proven difficult.

In certain lighting applications, it is desirable to run a primary power wire, sometimes referred to as a "run wire" and to connect or tap into the run wire at various points to power peripheral devices or components, such as low voltage lighting devices having LEDs. Known connectors for such purposes, are however, disadvantaged in several aspects.

Some known wire tap connectors require that the primary wire be cut or stripped of insulation to secure the wire conductors to the connector. Cutting and/or stripping of the primary wire can be time consuming, and in some installations can be challenging, especially when the primary wire is a dual conductor wire having separate conductors within an outer insulating jacket. Increased time or complexity in installing to the wire tap connectors translates into increased installation costs, and a lower cost installation is desired.

Further, in some connectors, the peripheral devices (e.g., low voltage lighting devices) must be separately connected or terminated to the wire tap connector. With known wire tap connectors, one wire tap connector is required for each device connected to the primary run wire. Particularly when a large number of peripheral devices are to be installed, or when more than one peripheral device is desired in the same general area, separately installing wire tap connectors for each peripheral device can be unnecessarily time consuming and difficult, and in other cases it can be impossible to achieve proper spacing of the peripheral devices.

BRIEF DESCRIPTION OF THE INVENTION

According to an exemplary embodiment, an electrical connector comprises a nonconductive center housing and a plurality of substantially planar contacts situated within the housing. Each of the contacts includes an insulation displacement section, and at least one stuffer is slidably mounted to the housing and configured to engage a primary wire to more than one of the insulation displacement sections.

Optionally, each of the contacts are configured for connection to multiple plug-in components, and the at least one stuffer comprises first and second stuffers located on opposite sides of the center housing. The contacts may be configured so that the insulation displacement section of each contact is staggered in position from an insulation displacement section of an adjacent insulation displacement section of another contact. The center housing may include at least a first receptacle and a second receptacle for a plug-in component, the second receptacle extending at an angle with respect to the first receptacle.

According to another exemplary embodiment, an electrical connector comprises a nonconductive center housing, and a plurality of substantially planar contacts situated within the housing. Each of the contacts includes a substantially planar insulation displacement section and a compliant pin section extending in the plane of the insulation displacement section. First and second stuffers are slidably mounted to the housing on opposite sides thereof and the stuffers are configured to engage a dual wire to more than one of the insulation displacement sections.

According to another embodiment, an electrical connector comprises a nonconductive center housing configured to receive a plurality of plug-in devices. A plurality of substantially planar contacts are situated within the housing, and each of the contacts including a substantially planar insulation displacement section and a compliant pin contact section extending in the plane of the insulation displacement section. At least one stuffer is slidably mounted to the center housing, and the stuffer has a wire cradle configured to receive a dual wire extending axially and continuously through the stuffer. The stuffer engages more than one of the insulation displacement sections to the dual wire when moved to a terminated position, thereby establishing electrical connection to the plurality of plug-in devices when press fit into the housing and engaged to the compliant pin sections of the contacts.

DETAILED DESCRIPTION OF THE INVENTION

Figure 1:
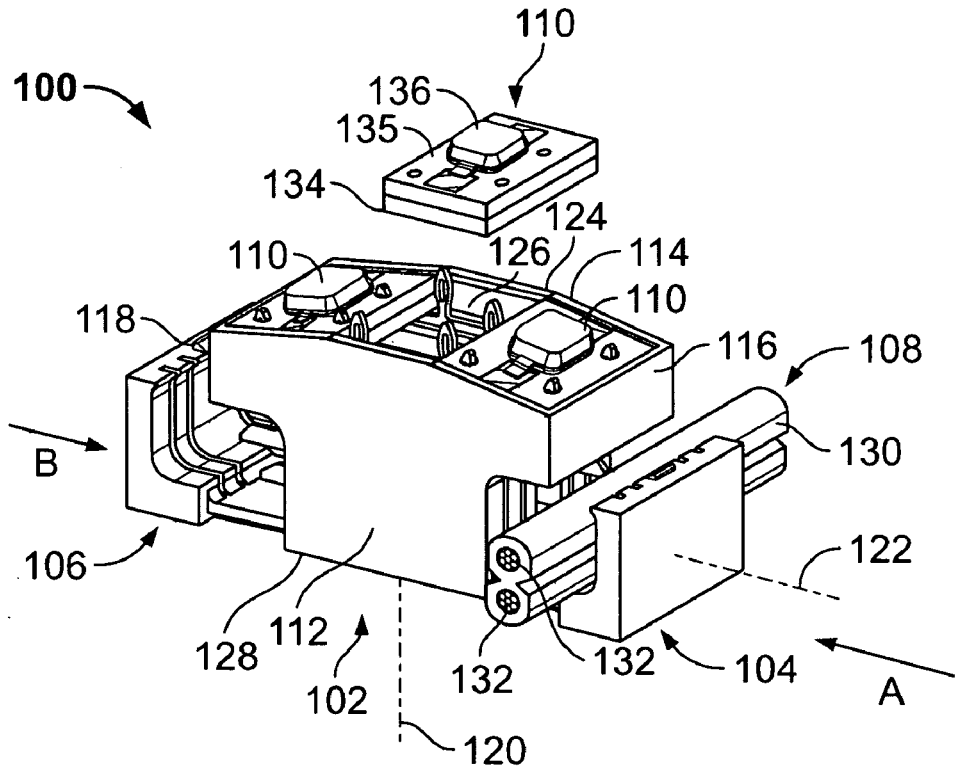
FIG. 1 is a perspective view of a connector assembly formed in accordance with the present invention and in a first assembled position.

FIG. 1 is a perspective view of a connector assembly 100 formed in accordance with the present invention and in a first assembled position. As illustrated in FIG. 1, the connector assembly 100 includes a nonconductive center housing 102 and a pair of nonconductive stuffers 104, 106 slidably mounted to the center housing 102. The stuffers are 104, 106 configured to mechanically engage respective primary run wires 108 extending axially and continuously through the connector assembly 100, and multiple plug-in electronic packages 110 engaged to the housing 102. As such, a single connector assembly 100 may be used to interface multiple plug-in devices 110 to respective run wires 108 placed in the stuffers 104, 106.

A plurality of contacts, described further below, are situated within the housing 102 and are configured to establish mechanical and electrical connection to the run wires 108 in the respective stuffers 104, and 106, and the contacts are further configured for press fit insertion of the plug-in packages 110. The connector assembly 100 may be assembled and connected to the run wires 108 and the plug-in devices 110 with relative ease and in a cost effective manner in comparison to conventional connectors.

The center housing 102 in an illustrative embodiment includes a front wall 112, a rear wall 114 opposite the front wall 112, and end walls 116, 118 interconnecting the front and rear walls 112, 114. The housing 102 is symmetrical about a vertical axis 120 and asymmetrical about a horizontal axis 122. An upper edge 124 of the center housing 102 defines receptacles or compartments 126 for the respective plug-in packages 110, while a lower edge 128 of the center housing 102 receives the stuffers 104 and 106. The stuffers 104 and 106 are positioned on opposite lateral ends of the center housing 102 adjacent the respective end walls 116, 118 of the center housing 102.

The stuffers 104 and 106 are selectively positionable relative to the center housing 102 in a direction parallel to the longitudinal or horizontal axis 122 between an assembled position as shown in FIG. 1 and a terminated position described below. In the assembled position, a clearance is created between a portion of the respective stuffers 104 and 106 and the end walls 116, 118 of the center housing 102 so that a respective run wire 108 may be loaded in the stuffers 104, 106. Once the run wires 108 are loaded therein, the stuffers 104, 106 may be moved in the directions of arrows A and B toward the center housing 102. The center housing contacts include insulation displacement sections, described further below, which penetrate outer insulation 130 of the run wires 108. In an exemplary embodiment, the run wires 108 are dual wires having the outer insulation 130 and separate internal conductors 132 therein. The insulation displacement sections of the housing contacts penetrate the insulation 130 and engage the conductors 132 as the stuffers 104, 106 are moved to the terminated position. The housing contacts are, in turn, configured to establish mechanical and electrical connection to the plug-in packages 110 with press fit insertion in the manner described below.

In an exemplary embodiment, the plug-in packages 110 are known light emitting electronic packages or devices including a printed circuit board 134, an aluminum heat sink 135, and a light emitting diode (LED) 136 mounted thereto. The housing contacts are configured for press fit insertion to the circuit boards 134 of the plug-in devices. While the connector assembly 100 has been found particularly advantageous for plug-in LED packages for a distributed lighting assembly, it is understood that other electronic packages may be used with the connector assembly to meet desired specifications for an alternative end use for the connector assembly 100. Further, while three plug-in electronic packages 110 are illustrated in FIG. 1, it is contemplated that greater or fewer electronic packages may likewise be employed in alternative embodiments of the invention.

Figure 2:
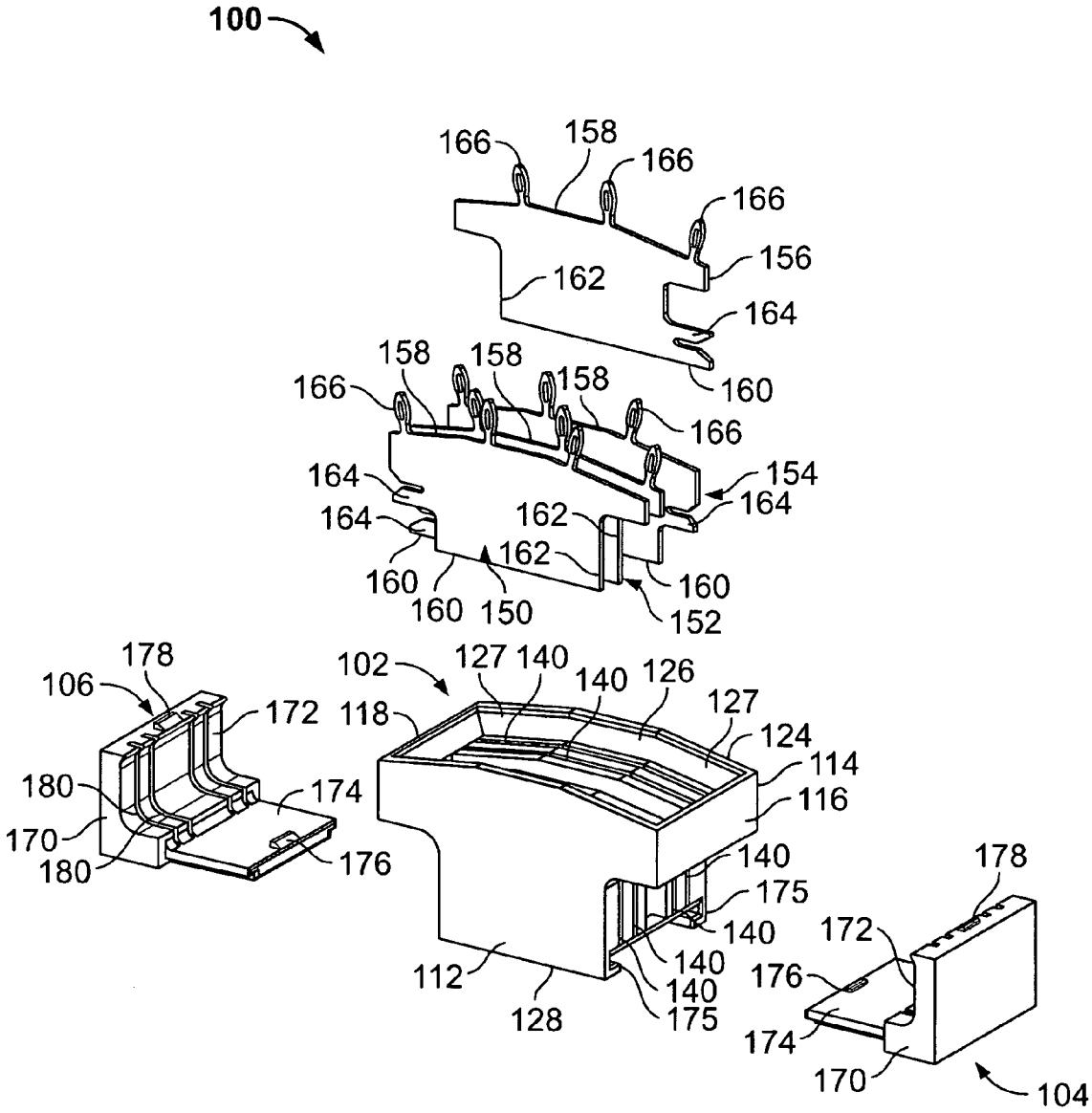
FIG. 2 is an exploded view of the connector assembly shown in FIG. 1.

FIG. 2 is an exploded view of the connector assembly 100 without the plug-in packages 110 shown in FIG. 1. The upper edge 124 of the center housing 102 defines a center receptacle 126 extending generally parallel to the lower edge 128 of the center housing 102, and side receptacles 127 on either end of the center receptacle 126 which are canted, sloped, or otherwise inclined with respect to the center receptacle 126. In an exemplary embodiment, the side receptacles 127 extend obliquely from the center receptacle 126 and are downwardly sloped away from the center receptacle 126 and toward the lower edge 128 of the housing 102. The canted side receptacles 127 allow for multiple plug-in devices 110 (FIG. 1) in a reduced amount of space between the end walls 116, 118 than if the plug-in devices 110 were oriented in a single plane at the upper edge 124 of the housing 102.

Contact slots 140 are formed in the housing 102 between the front wall 112 and the rear wall 114, and each of the contact slots is dimensioned to receive a substantially planar contact 150, 152, 154 or 156 in a generally parallel arrangement to one another in the housing 102. Each of the contacts 150, 152, 154 and 156 includes a contoured press fit engagement edge 158, a straight lower edge 160, a flat side edge 162 extending perpendicular from the lower edge 160, and an insulation displacement section 164 extending opposite the flat edge 164. The contacts 150, 152, 154 or 156 are fabricated from conductive sheets of material according to known techniques, such as punching and stamping formation techniques, to form substantially planar contacts 150, 152, 154 or 156.

The contoured press fit engagement edge 158 of each contact 150, 152, 154, and 156 is shaped in accordance with the upper edge 124, the front and rear walls 112, 114, and the receptacles 126, 127 of the housing 102. Accordingly, the engagement edge 158 of each contact has a center surface and canted side surfaces which follow the contour of the plug-in receptacles 126, 127. The canted side surfaces of the engagement edge 158 of each contact overhangs the respective flat side edge 160 and the respective insulation displacement section 164, and when the contacts 150, 152, 154, and 156 are inserted into the contact slots 140 in the housing 102, the insulation displacement sections 164 are exposed beneath the end walls 116, 118.

The contacts 150, 152, 154, and 156 are arranged in a first pair 150 and 152 and a second pair 154 and 156. Each of the insulation displacement sections 164 of the pairs of contacts face in opposite direction from one another. That is, the insulation displacement sections 164 of one pair is situated beneath the end wall 116 of the housing, and the insulation displacement sections 164 of the other pair of contacts is situated beneath the opposite end wall 118 of the housing. Thus, the contacts 150 and 152 each include insulation displacement sections 164 which face the stuffer 106 on one lateral end of the center housing 102, while the contacts 154 and 156 each include insulation displacement contact sections 164 which face the stuffer 104 on the other lateral end of the housing 102. Thus, the insulation displacement sections 164 of the pairs of contacts face one or the other of the stuffers 104 and 106, and each of the pairs of contacts is situated to engage one of the primary run wires 108 in the respective stuffers 104, 106.

Further, in an exemplary embodiment, each of the insulation displacement sections 164 in each pair of contacts is vertically displaced from one another in the housing 102 so that adjacent contacts of each pair includes insulation displacement sections 164 at different vertical elevations in the housing 102. For example, the contact 150 includes a lower insulation displacement section 164 at a first elevation from the lower edge 160, while the contact 152 includes an upper insulation displacement section 164 at a second elevation, greater than the first elevation, from the lower edge 160. Likewise the contact 154 includes a lower insulation displacement section 164 at a first elevation from the lower edge 160, while the contact 156 includes an upper insulation displacement section 164 at a second elevation, greater than the first elevation, from the lower edge 160. As such, the insulation displacement sections 164 of each respective contact 150, 152, 154, and 156 is staggered or separated from one another in both a vertical and horizontal dimension when the contacts 150, 152, 154, and 156 are inserted into the contacts slots 140 of the housing. It is contemplated, however, that other arrangements of the insulation displacement sections 164 may be utilized in alternative embodiments in lieu of the above-described arrangement to meet desired objectives and specifications for particular end uses and applications of the connector assembly.

Vertical and horizontal staggering, separation or offset of the contacts 150, 152, 154, and 156 is particularly advantageous when the connector assembly 100 is used with a dual run wire 108 (FIG. 8) because each of the insulation displacement sections 164 of the contacts 150, 152, 154, and 156 engages the run wire 108 (FIG. 1) at a different location, and each of the contacts 150, 152, 154, and 156 engages a different conductor 132 in the primary run wires 108. Thus, in an exemplary embodiment, four contacts 150, 152, 154, and 156 are provided to engage four separate conductors 132 in the run wires 108 when placed into the stuffers 104, 106. It is understood, however, that other arrangements of the contact displacement sections 164 may be utilized in alternative embodiments of the invention with different types of run wires 108 (e.g., single conductor run wires in lieu of dual conductor run wires) as needed or as desired. While four contacts 150, 152, 154, and 156 are illustrated in FIG. 2, it is understood that greater or lesser numbers of contacts could be provided in an alternative embodiment.

In a further exemplary embodiment, each of the press fit engagement edges 158 of the contacts 150, 152, 154, and 156 includes compliant pin, sometimes referred to as "eye of the needle", contacts 166 formed thereon. In one embodiment, each engagement edge 158 includes three compliant pin contacts 166, and each of the compliant pins 166 is located and dimensioned to engage one of the printed circuit boards 134 (FIG. 1) of the plug-in packages 110 (FIG. 1). As is evident from FIG. 2, the compliant pin contacts 166 are staggered on the contacts 150, 152, 154, and 156 so that the pin contacts 166 of the contacts 150, 152, 154, and 156 engage the plug-in packages 110 at various locations in the housing 102 when the packages 110 are press fit into the receptacles 126, 127 at the upper edge 124 of the housing 102. It is understood that the engagement edges 158 may include other features in lieu of compliant pin contacts 166 to establish electrical connection to the plug-in contacts 110.

The stuffers 104 and 106 are formed as mirror images of one another and include an L-shaped wire cradle portion 170 defining an engagement surface 172 to receive the run wire 108, and a mounting shelf or bracket 174 extending from the wire cradle portion 170. The lower edge 128 of the center housing 102 includes mounting rails 175 which slidably receive the brackets 174. The brackets 174 include locking tabs or projections 176 which cooperate with complementary apertures in the housing lower edge 128 to latch the stuffers to the housing 102 in the assembled position. Locking tabs or projections 178 are further provided in the wire cradle portions 172 to latch the stuffers to the housing 102 in the terminated position. The engagement surfaces 172 of the wire cradle portions 170 include contact slots 180 that receive the insulation displacement sections 164 of the contacts 150, 152, 154, and 156 when the stuffers 104, 106 are moved to the terminated position.

Figure 3:
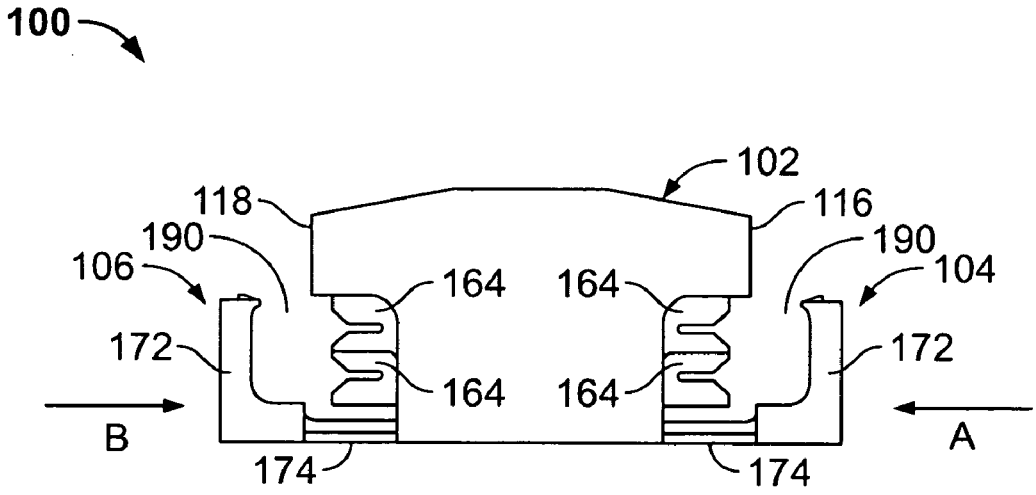
FIG. 3 is a front elevational view of the connector assembly shown in FIGS. 1 and 2 in the first position.

FIG. 3 is a front elevational view of the connector assembly 100 in the assembled position. The stuffers 104, 106 are attached to the center housing 102 via the mounting brackets 174 as described above. The contacts 150, 152, 154, and 156 (FIG. 2) are installed into the housing contacts slots 140 (FIG. 2) and the contact insulation displacement sections 164 are located beneath the end walls 116, 118 of the center housing 102, and are vertically and horizontally staggered relative to one another and separated from one another along vertical and horizontal axes 120 and 122 (FIG. 1). In the assembled position, a clearance 190 is created between the wire cradle portions 190 such that a run wire 108 (FIG. 1) may be received in the wire cradle portions 172 between the end walls 116, 118 and the insulation displacement sections 164 of the contacts 150, 152, 154, and 156. From the assembled position, the stuffers 104, 106 may be moved in opposite directions, indicated by arrows and B, toward the center housing 102 to engage run wires received in the stuffers to the terminated position. As the stuffers 104, 106 are moved in the direction of arrows A and B, the run wires 108 are engaged to the contact insulation displacement sections 164, which pierce the wire insulation 130 (FIG. 1) and mechanically and electrically engage the wire conductors 132 (FIG. 1).

Figure 4:
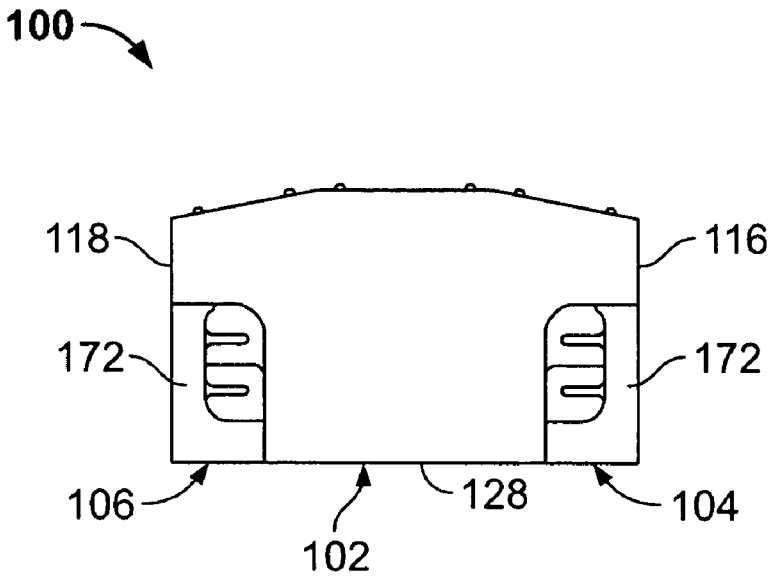
FIG. 4 is a front elevational view of the connector assembly shown in FIGS. 1 and 2 in a second terminated position.

FIG. 4 illustrates the connector assembly 100 in a terminated position wherein the stuffer brackets 174 (FIG. 3) are fully inserted into the lower edge 128 of the center housing 102, and the wire cradle portions 172 are flush with the end walls 116, 118 of the center housing 118. The insulation displacement sections 164 of the contacts 150, 152, 154, and 156 are received in the contact slots 180 (FIG. 2) of the wire cradle portions 172, and the run wire 108 (FIG. 8) is firmly mechanically and electrically engaged to the contacts 150, 152, 154, and 156 via the insulation displacement sections 164 (FIG. 3). Each of the stuffers 104, 106 engages one of the run wires 108 to multiple insulation displacement sections 164 of the contacts 150, 152, 154, and 156 by virtue of the staggered insulation displacement sections 164.

Figure 5:
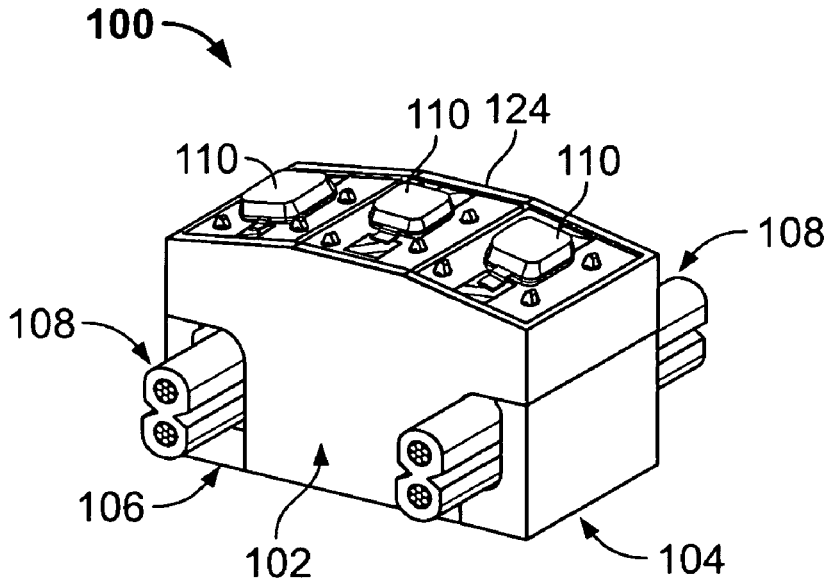
FIG. 5 is a perspective view of the connector assembly shown in FIG. 1 in the terminated position.

FIG. 5 illustrates the connector assembly 100 in the terminated position with run wires 108 received in the stuffers 104, 106 and engaged to the contacts 150, 152, 154, and 156 (FIG. 2) via the insulation displacement sections 164 (FIG. 3). The plug-in packages 110 are received in the upper edge 124 of the center housing 102 and mechanically and electrically engaged to the engagement edges 158 (FIG. 2) of the contacts 150, 152, 154, and 156 in the manner described above. By virtue of the sliding stuffers 104, 106 and the press fit plug-in packages, the connector assembly 100 may be installed in minimal time without stripping the run wires 108 of insulation, and without individually terminating each of the plug-in packages to the connector assembly 100. Multiple plug-in packages 110 may be connected to more than one run wire 108 with relative ease of installation, thereby reducing installation time and cost. As also noted above, the connector assembly 102 interfaces multiple plug-in packages 110 in a compact, space saving configuration which allows for a greater density of connectors and plug-packages 110 in a given space in, for example, a distributed lighting assembly.

Figure 6:
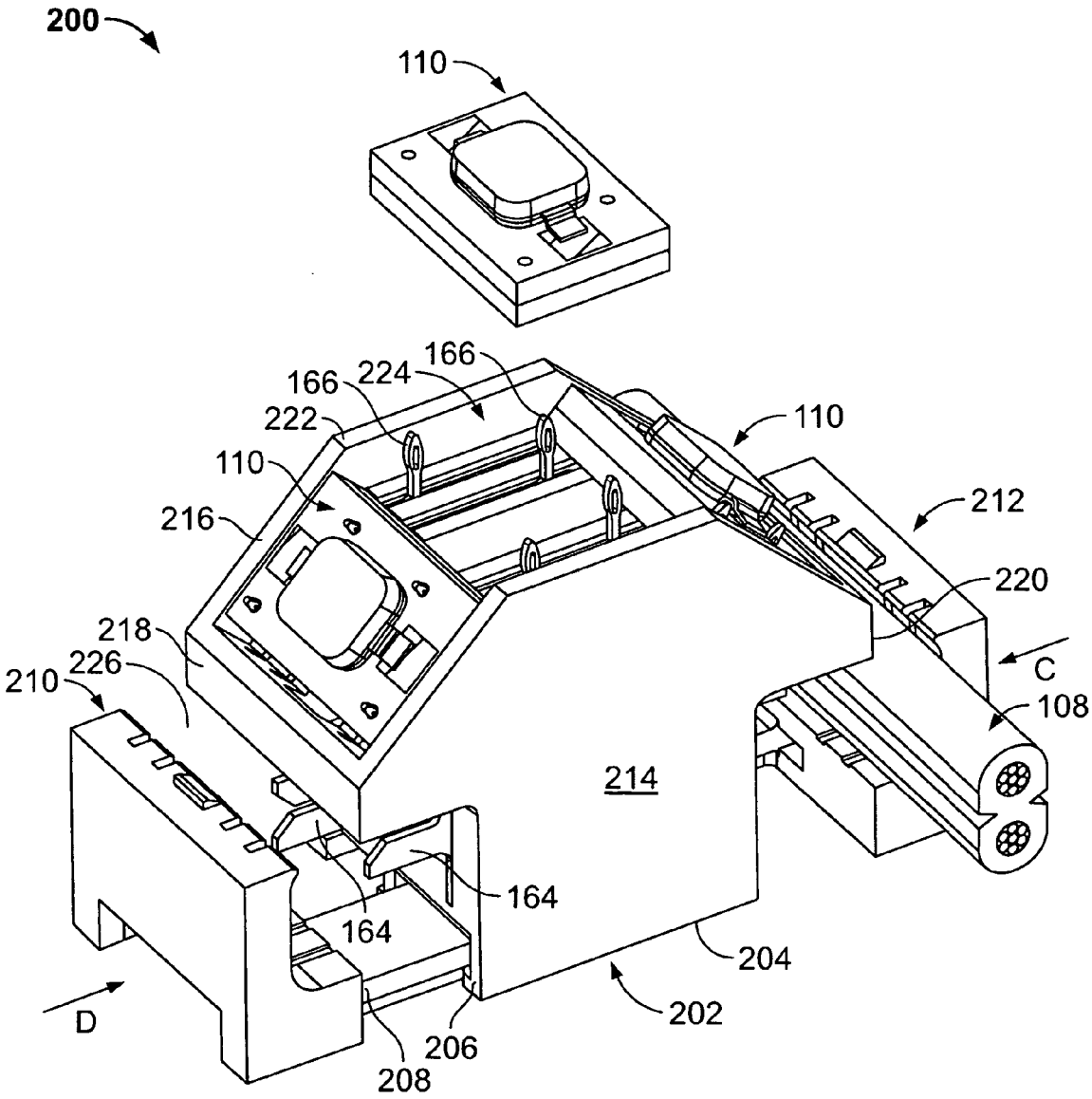
FIG. 6 is a perspective view of another embodiment of a connector assembly.

FIG. 6 is a perspective view of another embodiment of a connector assembly 200, which is similar in many aspects to the connector assembly 100 of FIGS. 1–5. The connector 200 interfaces multiple electronic packages 110 to run wires 108 in a relatively simple and low cost manner and in a space saving configuration.

The connector assembly 200 includes a center housing 202 having a lower edge 204 formed with mounting rails 206 which slidably receive mounting brackets 208 of left and right stuffers 210, 212. Unlike the connector assembly 100, the mounting brackets 208 of the stuffer are smaller in profile and extend only partly across the width of the connector housing, as measured between the front and rear walls 214, 216 of the center housing.

The center housing 202 includes contacts substantially similar to the contacts 150, 152, 154, and 156 having insulation displacement sections 164 that are staggered vertically and horizontally beneath the end walls 218, 220, and compliant contact pins 166 at an upper engagement edge adjacent an upper edge 222 of the center housing 202. The upper edge 222 includes canted receptacles for electronic packages 110 on either side of a center receptacle 224. The canted receptacles extend obliquely from the center receptacle 224 at a greater degree of incline than in the connector assembly 100, and therefore offers even greater space saving advantages for multiple plug-in packages 110.

As illustrated in FIG. 6, the connector assembly 200 is in an assembled position wherein the stuffers 210, 212 are positioned relative to the center housing 202 to provide a clearance 226 to receive a respective run wire 108. The stuffers 104, 106 are slidably movable to a terminated position in the direction of arrows C and D to connect the plug-in devices 110 to the run wires 108 in the manner described above.

While the invention has been described in terms of various specific embodiments, those skilled in the art will recognize that the invention can be practiced with modification within the spirit and scope of the claims.

What is claimed is:

1. An electrical connector comprising:

a nonconductive center housing defining multiple receptacles, each receptacle configured to receive a plug-in electronic package;

a plurality of substantially planar contacts situated within the housing, each of the contacts including an insulation displacement section and a compliant pin section, the compliant pin section configured to engage a corresponding one of the plug-in electronic packages; and at least one stuffer slidably mounted to the housing and configured to simultaneously engage one primary wire to more than one of the insulation displacement sections to establish electrical connection for the plug-in electronic package in each of the receptacles.

2. An electrical connector in accordance with claim 1 wherein each of the contacts are configured for connection to multiple plug-in electronic packages.

3. An electrical connector in accordance with claim 1, wherein said center housing comprises opposite front and rear walls, and opposing lateral ends extending substantially perpendicular to said front and rear walls, said at least one stuffer being mounted on one of the lateral ends.

4. An electrical connector in accordance with claim 1, wherein the at least one stuffer comprises first and second stuffers located on opposite sides of the center housing.

5. An electrical connector in accordance with claim 1 wherein each of the plurality of contacts includes a plurality of compliant pin contacts.

6. An electrical connector in accordance with claim 1 wherein the contacts are configured so that the insulation displacement section of each contact is staggered in position from an insulation displacement section of an adjacent insulation displacement section of another contact.

7. An electrical connector in accordance with claim 1 wherein the at least one stuffer is selectively positionable with respect to the center housing between an assembled position and a terminated position.

8. An electrical connector in accordance with claim 1 wherein the more than one insulation displacement sections comprises a pair of insulation displacement sections, the pair of insulation displacement sections offset from one another in at least one of a horizontal and a vertical direction with respect to the stuffer.

9. An electrical connector in accordance with claim 1 wherein the center housing includes at least a first receptacle and a second receptacle for a plug-in component, the second receptacle extending at an angle with respect to the first receptacle.

10. An electrical connector comprising:

a nonconductive center housing comprising opposite front and rear walls, and opposing end walls interconnecting said front and rear walls;

a plurality of substantially planar contacts situated within the housing, each of the contacts including a substantially planar insulation displacement section and a compliant pin section extending in the plane of the insulation displacement section; and first and second stuffers slidably mounted to the housing, said first and second stuffers each mounted to a respective one of said opposing end walls and each of said first and second stuffers being selectively positionable relative to said opposing end walls in an assembled position and a terminated position, the first and second stuffers being movable in opposite directions toward one another to the terminated position to engage a respective dual wires to more than one of the insulation displacement sections.

11. An electrical connector in accordance with claim 10, wherein the housing includes multiple receptacles, each receptacle configured to receive a plug-in device, the compliant pin section engaging the plug-in devices when received in the respective receptacles.

12. An electrical connector in accordance with claim 10 wherein the contacts are configured so that the insulation displacement section of each contact is staggered in position from an insulation displacement section of an adjacent insulation displacement section of another contact.

13. An electrical connector in accordance with claim 10 wherein the first and second stuffers are movable relative to the center housing along a horizontal axis to the terminated position establish electrical connection to the respective run wires.

14. An electrical connector in accordance with claim 10 wherein the more than one insulation displacement sections comprises a pair of insulation displacement sections, the pair of insulation displacement sections offset from one another in at least one of a horizontal and a vertical direction with respect to one of the first and second stuffers.

15. An electrical connector in accordance with claim 10 wherein the center housing includes a center receptacle and first and second side receptacles extending on opposite sides of the center receptacle, each of the first and second side receptacles extending at an angle with respect to the center receptacle.

16. An electrical wire tap connector comprising:

a nonconductive center housing configured to receive at least one plug-in device along a first axis;

a plurality of substantially planar contacts situated within the housing, each of the contacts including a substantially planar insulation displacement section and a compliant pin contact section extending in the plane of the insulation displacement section, wherein the insulation displacement section of each contact extends along a second axis, the second axis being substantially perpendicular to the first axis; and at least one stuffer slidably mounted to the center housing and slidably positionable along the second axis, the stuffer having a wire cradle configured to receive a dual primary run wire extending axially and continuously through the stuffer, the stuffer engaging more than one of the insulation displacement sections to the dual primary run wire when moved to a terminated position, thereby establishing an electrical tap connection between the at least one plug-in device and the dual primary run wire when the at least one plug-in device is press fit into the center housing and engaged to the compliant pin sections of the contacts.

17. An electrical connector in accordance with claim 16, wherein the plug-in devices are LED packages, the compliant pin sections of the contacts arranged wherein more than one compliant pin section of the contact engages each plug-in device.

18. An electrical connector in accordance with claim 16 wherein the contacts are configured so that the insulation displacement section of each contact is staggered in position along the first axis from an insulation displacement section of an adjacent insulation displacement section of another contact.

19. An electrical connector in accordance with claim 16 wherein the more than one insulation displacement sections comprises a pair of insulation displacement sections, the pair of insulation displacement sections offset from one another in at least one of a horizontal and a vertical direction with respect to the stuffer.

20. An electrical connector in accordance with claim 16 wherein the center housing includes a center receptacle and first and second side receptacles extending on opposite sides of the center receptacle, each of the first and second side receptacles extending at an angle with respect to the center receptacle.

* * * * *

UNITED STATES PATENT AND TRADEMARK OFFICE

CERTIFICATE OF CORRECTION

PATENT NO. : 7,156,689 B2
APPLICATION NO. : 11/036673
DATED : January 2, 2007
INVENTOR(S) : David James Fabian et al.

It is certified that error appears in the above-identified patent and that said Letters Patent is hereby corrected as shown below:

Title page, item (75) should read as follow: Scott Stephen Duesterhoeft

Signed and Sealed this

Sixth Day of March, 2007

JON W. DUDAS
*Director of the United States Patent and Trademark Office*